US009630737B2

(12) United States Patent
Draper

(10) Patent No.: US 9,630,737 B2
(45) Date of Patent: Apr. 25, 2017

(54) METHOD OF MAKING AN ASPHALT CONTAINER

(71) Applicant: Neil Draper, Lexington, KY (US)

(72) Inventor: Neil Draper, Lexington, KY (US)

( * ) Notice: Subject to any disclaimer, the term of this patent is extended or adjusted under 35 U.S.C. 154(b) by 491 days.

(21) Appl. No.: 14/482,335

(22) Filed: Sep. 10, 2014

(65) Prior Publication Data

US 2015/0082748 A1 Mar. 26, 2015

Related U.S. Application Data

(60) Provisional application No. 61/882,204, filed on Sep. 25, 2013.

(51) Int. Cl.

| | |
|---|---|
| ***B65D 5/06*** | (2006.01) |
| ***B65D 5/40*** | (2006.01) |
| ***B31B 1/00*** | (2006.01) |
| ***B31B 1/14*** | (2006.01) |
| ***B31B 1/25*** | (2006.01) |
| ***B31B 1/26*** | (2006.01) |
| ***B65D 5/36*** | (2006.01) |
| ***B65D 5/44*** | (2006.01) |
| ***B65D 5/56*** | (2006.01) |
| *B65D 85/00* | (2006.01) |

(52) U.S. Cl.

CPC ..... *B65D 5/061* (2013.01); *B65D 5/3628* (2013.01); *B65D 5/445* (2013.01); *B65D 5/563* (2013.01); *B31B 2219/23* (2013.01); *B31B 2219/62* (2013.01); *B31B 2221/20* (2013.01); *B31B 2221/40* (2013.01); *B65D 85/70* (2013.01)

(58) Field of Classification Search

CPC ..... B65D 5/061; B65D 5/445; B65D 5/563; B31B 2219/23; B31B 2219/62; B31B 2221/20; B31B 2221/40

USPC ..... 383/121, 125, 119, 120; 229/117.01, 229/184; 53/440

See application file for complete search history.

(56) References Cited

U.S. PATENT DOCUMENTS

| | | | | |
|---|---|---|---|---|
| 2,310,712 A | | 2/1943 | Schmied | |
| 2,760,629 A | | 8/1956 | Thagard, Jr. | |
| 3,068,621 A | * | 12/1962 | Burrell | B65D 5/48024 206/447 |
| 3,366,233 A | | 1/1968 | Roediger | |
| 4,548,593 A | * | 10/1985 | Tisma | B65D 5/0227 229/184 |
| 5,158,371 A | * | 10/1992 | Moravek | B65D 33/02 383/104 |
| 5,452,800 A | | 9/1995 | Muir | |
| 5,762,260 A | * | 6/1998 | Goglio | B65D 33/007 229/199 |

(Continued)

FOREIGN PATENT DOCUMENTS

CA 2223323 A1 12/1996

*Primary Examiner* — Andrew M Tecco
*Assistant Examiner* — Praachi M Pathak
(74) *Attorney, Agent, or Firm* — Michael Coblenz

(57) ABSTRACT

A method of making a one piece, leak proof container for holding and transporting hot melt asphalt. The container is made from a sheet of heavy duty cardboard which is coated on one side, folded and glued to create a leak proof container. The sheet has a series of pre-scored fold lines to allow the sheet to be folded into a container with a leak proof bottom. A series of reinforcing sheets are added to the bottom of the container to provide reinforcement, and to create the leak proof base.

16 Claims, 4 Drawing Sheets

(56) References Cited

U.S. PATENT DOCUMENTS

| | | | | |
|---|---|---|---|---|
| 5,765,686 | A * | 6/1998 | Wright | B65D 1/22 206/447 |
| 5,772,332 | A * | 6/1998 | Geller | B29C 65/18 220/9.1 |
| 6,044,625 | A | 4/2000 | Waver et al. | |
| 7,350,644 | B2 | 4/2008 | Harwell et al. | |
| 2010/0260444 | A1 * | 10/2010 | Narula | B65D 33/02 383/119 |
| 2013/0036714 | A1 | 2/2013 | Bolton et al. | |
| 2013/0075298 | A1 * | 3/2013 | Chehovits | B65B 29/00 206/524.7 |
| 2015/0076144 | A1 * | 3/2015 | Chalifoux | B65D 5/3692 220/6 |
| 2016/0075467 | A1 * | 3/2016 | Pipes | B65D 5/0227 229/120.37 |

* cited by examiner

METHOD OF MAKING AN ASPHALT CONTAINER

CROSS REFERENCE TO RELATED APPLICATIONS

This application claims priority to U.S. Provisional Application No. 61/882,204, filed on Sep. 25, 2013, the teachings of which are fully incorporated herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates to a method for making a coated cardboard container configured for the packaging of asphalt. The asphalt may be filled hot, in a molten state, and it then solidifies within the container. The container acts as the shipping medium through which the asphalt is transported to its end user. At the end user of the solidified asphalt the container may be easily peeled away from the solidified asphalt leaving a conveniently sized and shaped solid block which is suitable for further processing.

Description of the Related Art

Asphalt is used for many purposes, such as roofing or road work. Asphalt is typically made in one location then packaged and shipped to the end user for use. Asphalt is typically prepared hot, poured into a container and then allowed to cool and solidify. The cooled asphalt is solid, but still sticky to the touch. The container allows the asphalt to be handled and shipped. Without the container the blocks of asphalt would adhere to each other. The common methods of packaging hot asphalt currently in use require the asphalt producer to have machinery. This machinery may be needed to cool the asphalt prior to dispensing into a packaging material, for shaping the asphalt prior to packaging, for enveloping the asphalt in a packaging material or to assist in assembling a container into which the asphalt may be filled and packaged.

There are a number of patents for asphalt containers. U.S. Pat. No. 2,310,712 to Schmied discloses a boxed lined with film or coatings to contain asphalt poured hot into the box. The coating prevents the asphalt from adhering to the material of the box. U.S. Pat. No. 2,760,629 to Thagard discloses a cardboard tube placed on a separate base for holding asphalt. The tube is constructed by stitching the sides of the tube together and then stitching the bottom on to the end of the tube. U.S. Pat. No. 3,366,233 to Roediger discloses a specially lined bag for holding and transporting asphalt. The interior lining is made up of a heat resistant film. U.S. Pat. No. 5,452,800 to Muir discloses a box lined with a special film that allows asphalt to harden into uniform blocks for ease of shipping. Asphalt is most commonly transported in cardboard of fiber drums, or tubes, having a metal bottom adhered to the end of the tube.

Manufacturers of Built Up Roofing or BUR asphalt, who need to pack their product in a container with a capacity of 50 lbs to 100 lbs to meet market demand, and who do not wish to use slower production methods involving molding a block of asphalt and then wrapping it in plastic film, are almost exclusively using a two piece keg consisting of a coated cylindrical cardboard sleeve and a circular metal base. The two components of the keg, the lined cardboard sleeve and the round metal base, are supplied in flat form to the asphalt manufacturer who then needs a special machine to crimp the circular metal base to the cylindrical cardboard sleeve in order to form the keg. This method is time consuming and labor intensive. The machinery for crimping the metal base and attaching it to the cardboard sleeve is prone to malfunction, and when it fails it requires specialist engineers to make repairs, which is costly and inconvenient. In cases where the metal base does not crimp satisfactorily to the cardboard sleeve the keg will malfunction and asphalt will leak out, causing disruption and product loss. Unfortunately it is often difficult to determine whether the leakage is due to a faulty crimping process which adhered the metal base to the cardboard sleeve, or to faulty components. This makes it hard for the asphalt manufacturer to determine how to fix the problem. The fact that the keg has a metal base is also a disadvantage for the end user for a number of reasons. First it can make removing the asphalt from the packaging more difficult due to the asphalt adhering to the metal base. Second the metal base can have sharp edges, which can cause injuries to workers trying to remove the asphalt. Finally, it makes disposal of waste more difficult because of the metal component.

SUMMARY OF THE INVENTION

The invention is a method for manufacturing a ready to use, one-piece leak proof asphalt container that does not require machinery for assembly by the asphalt manufacturer. The asphalt manufacturer receives a premade and ready to use container which simply needs opening prior to filling, which is a much quicker and economical process than crimping a metal base to the cardboard sleeve to form a keg prior to filling. Because the container is made entirely of cardboard and the interior, including the base, is fully coated, the container is easily removed from the asphalt by the end user. This also means that there are no metal edges to potentially cause injury to workers, and the disposal of waste is much easier because it is entirely cardboard without metal components.

The asphalt container is designed in such a way that the method of cutting, creasing, folding and sealing renders it leak proof when assembled so that molten asphalt may be securely contained therein. The container is made from cardboard with an internal silicone release coating. This coating is resistant to the very high temperatures at which molten asphalt is filled and it has excellent release properties so the asphalt will not stick to it. This means that the solidified asphalt may be cleanly and easily removed from the container without contaminating the asphalt with cardboard or paper fibers. The adhesives which are used to bond the container are resistant to the very high temperatures at which asphalt is filled so that the container retains it's integrity even under the stress of intense heat and pressure. The container may be collapsed flat for shipping thus minimizing transport costs and may be easily "popped open"

by an operator prior to filling without the need for machinery. The filled container provides good protection for the asphalt during storage and transportation. Because the container is made entirely from coated cardboard and has no metal parts it is safer for the end user to open and when empty is easily disposed of.

DETAILED DESCRIPTION OF THE INVENTION

Figure 2:
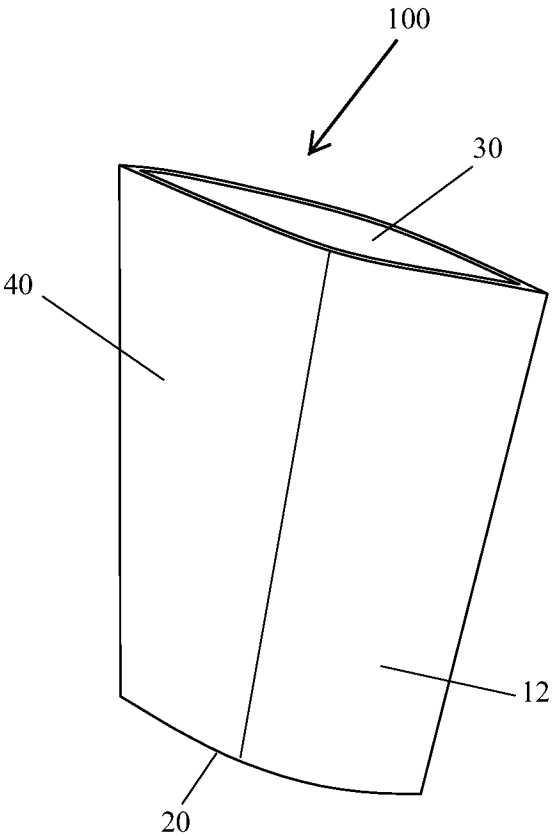
FIG. 2 is a perspective view of the assembled and folded sleeve.

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

The asphalt container 100 is made from heavy duty cardboard. This type of cardboard is typically manufactured and shipped in large rolls, which are then cut to sheets of the desired size. This cardboard may be single ply or multi ply or corrugated. It may be composed of 100% virgin pulp or 100% recycled paper or a combination of the two. It may be coated or uncoated cardboard stock. It may vary in thickness from between 0.05" to 0.25". A preferred material is one with multi ply solid fibreboard with a high percentage of virgin pulp in a thickness between 0.010" and 0.050." A particularly preferred material is 100% virgin kraft fibreboard with a thickness between 0.013" and 0.035". A most preferred material is an uncoated 100% virgin kraft fibreboard with a thickness between 0.018" and 0.026" and sold by Kapstone Paper & Packaging Corporation under the trade name Kraftpak®. Generally a thicker material is used for a larger container to accommodate the weight of the contained asphalt. The base cardboard material may be used alone or it may be laminated together to increase thickness. The base cardboard material may be left uncoated, it may have a coating applied directly to it or it may have a coated paper laminated to it.

The cardboard from which a container is to be manufactured for the filling and packing of molten asphalt may be coated directly or it may have a pre coated paper laminated to it. The coating is applied to the inside 41 of the sheet 10 which will become the inside of the container 100. In the case of direct coating the material could be wax, polymers such as Polyethylene (PE), Polypropylene (PP) or Polyethylene terephthalate (PET), Quilon®, stearic acid, silicone or others which provide the desired properties. A preferred material is emulsion silicone applied at a dry weight of between 0.5 gsm and 5.0 gsm. (Note: gsm, or grams per square meter is also abbreviated $g/m^2$ but denoted herein as gsm.) A most preferred material is a 3 part emulsion silicone supplied by Bluestar Silicones under the trade name Silcolease®, and applied at a dry weight of between 1.5 gsm and 3.0 gsm. Coatings may be applied to the inside or outside of the cardboard or both in order to provide properties such as vapor barrier, liquid barrier, grease and oil resistance, heat resistance, release properties, anti-corrosion properties or other barrier properties necessary for the proper function of the container to made from the cardboard. In the case of a pre coated paper the material could be wax, polymers such as PE, PP or PET, Quilon®, Stearic Acid or Silicone. The paper could be recycled chip, kraft, clay coated kraft or super calendered kraft. A preferred material would be a silicone coating applied to a clay coated kraft or super calendered kraft at a dry coating weight of 0.5 gsm 5.0 gsm. A particularly preferred material would be a solventless silicone applied to clay coated kraft or super calendered kraft at a dry weight of 1.0 gsm to 4.5 gsm. A most preferred material would be a platinum catalyzed solventless silicone supplied by Wacker Chemicals under the trade name DEHESIVE® applied to a clay coated kraft or super calendered kraft at a dry weight of 1.5 gsm to 2.5 gsm. The silicone release coating may be applied directly to the cardboard, in roll form, from which the container is made or, for superior results, applied to a specialized base paper which is then laminated to the cardboard.

One edge of the cardboard roll is left free of silicone release coating in order to allow gluing of the side seam of the container 100 with a water based adhesive. Once cut to size this is uncoated portion of the inside 41 is known as the glue strip 11 because it is where the glue is applied.

Figure 1:
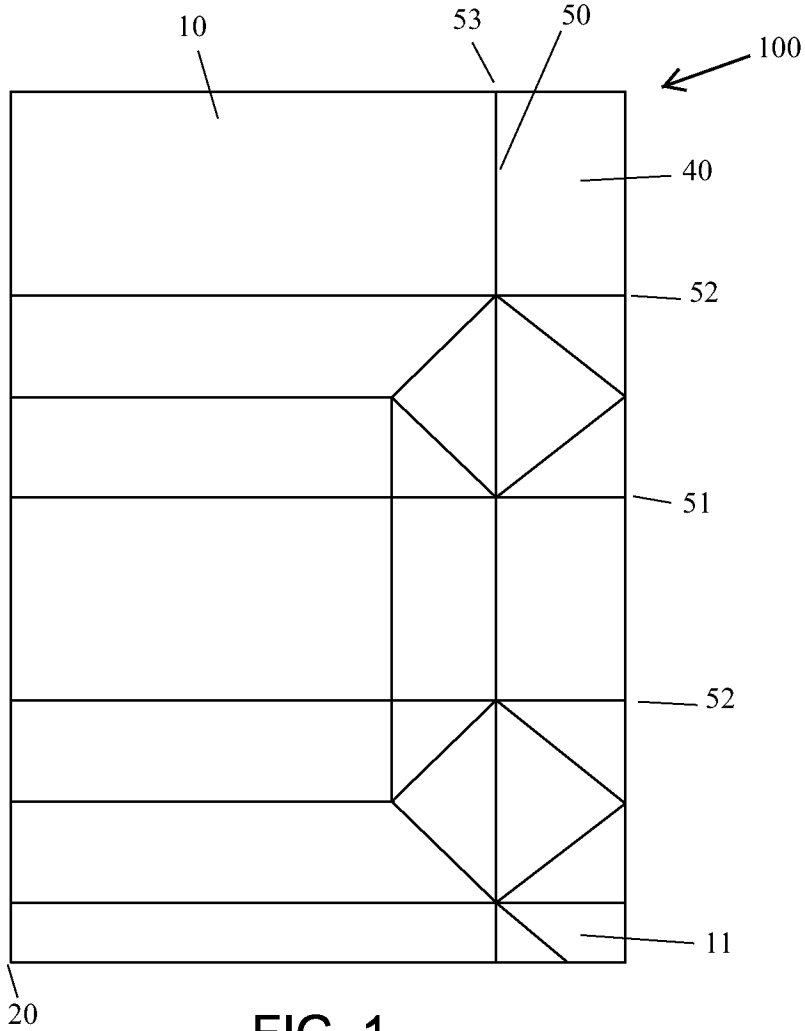
FIG. 1 is a top plan view of the cut cardboard sheet with scored fold lines.

The cardboard is then cut into sheet form. In the preferred embodiment the final asphalt container 100 will be roughly 2 feet tall and have a square cross section roughly 10.5" on a side. These sized can vary according to the needs of the end user, from as small as six inches on a side to as large as two feet on a side, and from heights of twelve inches to as much as four feet, though the size of the container won't be significantly larger because it will become too heavy and unwieldy, nor too small as to make use inconvenient. The typical filled weight of asphalt containers is in the range of 50 lbs to 100 lbs, but this container, when made from appropriately thick material, can be larger and hold much higher weights. In the preferred embodiment the cut sheet 10 will be a rectangle of approximately 26½" by 44". FIG. 1 shows the cut sheet 10.

After the sheet 10 is cut a series of fold lines 50 are scored or embossed into the outside 40 of the sheet 10. The fold lines 50 allow the sheet 10 to be folded in the same place to create the container 100. The cut shape represents the final form of the container 100 and by adjusting the length, width, and height, the desired container capacity may be achieved as well as the shape of container 100 required by the customer to best suit his needs in respect of method of filling, method of storage and transportation or the specific shape desired by his end user. The scored fold lines 50 determine the way in which the container 100 is to be folded to achieve the desired shape, the way in which it is folded to seal the base 130 to make it leak proof, and the way in which it is folded to enable it to be collapsed into a flat shape for efficient storage and transportation. There is a mid-fold line 51 which allows the sheet 10 to be folded in half to form the flat sleeve 12 (FIG. 2), two side fold lines 52 which allow the flat sleeve 12 to be opened to from a rectangular tube 13 (FIG. 3), a bottom fold 53 where the bottom components are folded to form the leak proof base 130 of the container (FIG. 3 to FIG. 9)

The cut and creased sheet 10 is folded in half at the mid-fold line 51 and the glue strip 11 is folded over and glued against a matching strip on the outside 40 of the sheet 10 using a special heat resistant adhesive, to form a flat sleeve 12 as shown in FIG. 2. This is achieved by feeding the sheet 10 into an automatic machine which applies adhesive along the glue strip 11. The width of the glue strip 11 is much greater than that used to produce conventional bonded cardboard sleeves to provide an exceptionally wide bonded surface which is necessary for the container to function properly. The width of the glue strip 11 may be between 1" and 6". A most preferred width is between 2.5" and 4.0". The pattern of adhesive is such that when compressed it will spread to give 100% surface coverage along the glue strip to fully seal the edge of the container 100. After the adhesive is applied the cut and creased sheet 10 travels down the machine guided by powered belts and is slowly folded over at the mid fold line 51 with the inside 41 folded in toward itself to form a sleeve 12, and with the glue strip 11 on the inside 41 being pressed against and adhered to the opposite edge on the outside 40. Once the flat sleeve 12 has been formed it passes through a compression section where the bond on the glue strip 11 is further pressed together to ensure good adhesion. After emerging from the compression section the flattened sleeve 12 is palletized and stored for at least 24 hours to allow proper bond formation before moving on to the forming stage.

Figure 3:
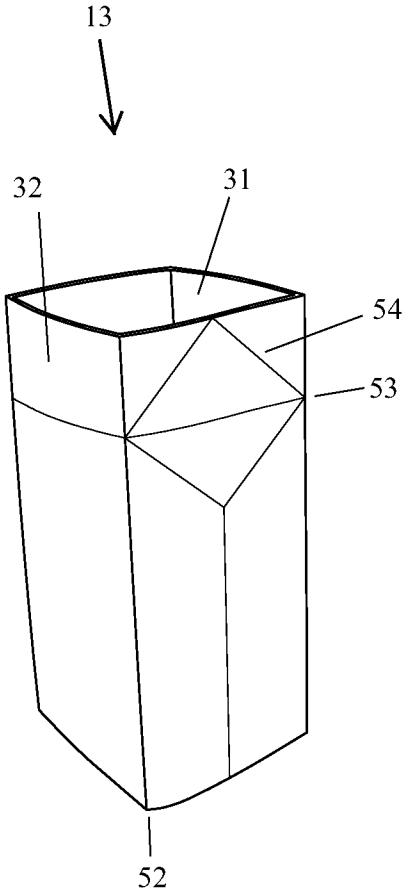
FIG. 3 is a perspective view of the unfolded sleeve.

The cardboard sleeve 12 is opened into a rectangular tube 13 by pushing on the insides to allow it to open along the scored side fold lines 52. The rectangular tube 13, shown in FIG. 3, is placed over a forming stand with a horizontal plate that has a length and width that is slightly less than the internal length and width of the finished container 100. This allows the container 100 to be folded on the forming stand. The rectangular tube 13 has a top end 20 and a bottom end 30, and four sides. Typically the sides are equal in length to give the tube 13 a square cross section as shown in the drawings, but the sides can be of different sizes to give the tube 13 a rectangular cross section. FIG. 3 shows the tube 13 placed over the forming stand with the forming stand inside the open tube 13, and therefore not visible in the drawing. The forming stand has an adjustable height, and is set to the height of the finished container 100, which allows the base 130 of the container 100 to be folded on the forming stand. The tube 13 is place over the forming stand with the bottom end 30 at the top so that it can be folded to form the base 130 of the container 100. The forming stand is adjusted to be even with the bottom fold line 53. The length of the portion of the tube 13 protruding above the upper surface of the horizontal plate will be between 51% and 99% of the width of the finished container to form an overlap on the folded base 130. A most preferred length of the portion of the sleeve protruding above the upper surface of the horizontal plate is 60% to 62% of the width of the finished container to provide sufficient overlap of the bottom portion to produce a leak proof seal 130.

Figure 4:
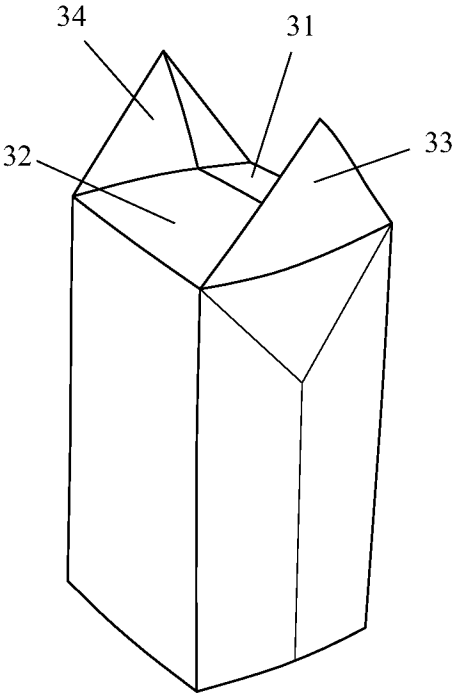
FIG. 4 is a perspective view of the sleeve with the first fold closing the bottom of the container.

The forming of the base 130 of the container 100 involves manipulation of the cardboard along the scored folding lines 50. Once this folding has produced the desired shape, the shape and structure is made permanent through the use of adhesive and adhesive coated paper sheets. In the first step the two opposite base sides 31 and 32, are folded downwards and flattened against the upper surface of the horizontal plate as shown in FIG. 4. This is achieved by folding the base sides 31 and 32 down and folding the bottom flap lines 54 inward, which produces the base flaps 33 & 34. The two base sides 31 & 32 overlap each other and create the first flat bottom 71.

There is a first reinforcing sheet 61 and a second reinforcing sheet 62 that are adhered to the bottom to strength the base 130 of the container 100, as described below. The first and second reinforcing sheets 61 & 62 are made from the same material, which may be recycled or virgin kraft paper or a combination of the two. They may be coated or uncoated. They may have coatings pre-applied to aid in the process of constructing the base or to provide other desirable properties to enhance the container 100. For example these paper reinforcing sheets could have a pre applied adhesive or heat seal coating to negate the need for adhesive application during the construction process. Or they could be coated with a barrier material, for example a water resistant coating could be applied to the outside surface of the second reinforcing sheet 62 which is to form the final end cap of the base 130 so as to provide water resistance to the base 130 of the container 100 if it were to be placed on wet surfaces. For the cardboard which is to be used in the construction of a container 100 for filling and packing molten asphalt the most preferred paper is a virgin kraft liner with a recycled content of approximately 30%, similar to the paper sold by Kapstone Paper under the trade name HS liner, and with a thickness of between 0.002" and 0.013".

The first and second reinforcing sheets 61 & 62 are glued to the bottom of the container with an adhesive. The adhesive used to bond the components of the container may be water based, solvent based, 100% solids liquid or hot melt. It may be applied by means of extrusion, roller, spray, jet, brush, wheel or any other application method. It's purpose is to bond the materials together in such a way that the container 100 may be constructed efficiently, that the materials to be bonded will be adhered sufficiently for the container 100 to carry out the function for which it is intended, and that the adhesive bond will withstand any stresses placed upon it while the container 100 is in use. For the container 100 to be used for the filling and packing of molten asphalt the preferred adhesive is a water based synthetic emulsion with a solid content of between 20% and 70%, and which imparts a bond having high heat resistance. A most preferred adhesive is a synthetic emulsion adhesive marketed by Summit Adhesives LLC with the reference number 701 which has a solid content of between 40% and 60% and which imparts a bond between paper and cardboard which has exceptionally high heat resistance.

Figure 5:
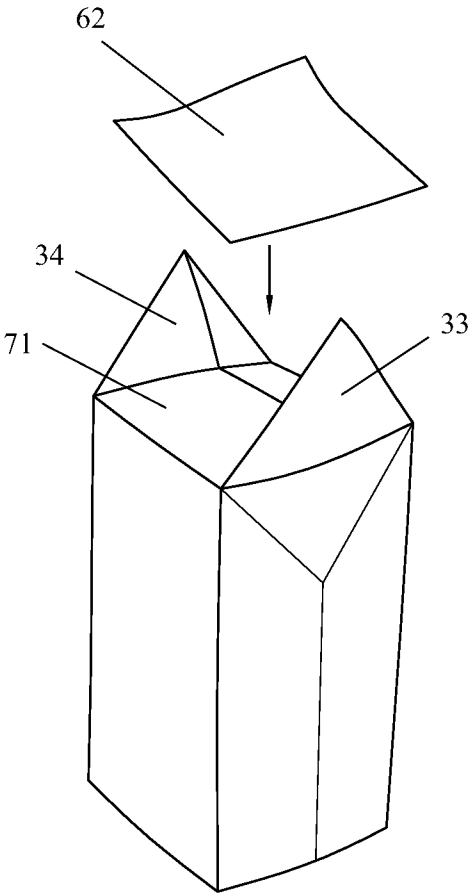
FIG. 5 is a perspective view of the first reinforcing sheet in place to be attached to the bottom of the container.
Figure 6:
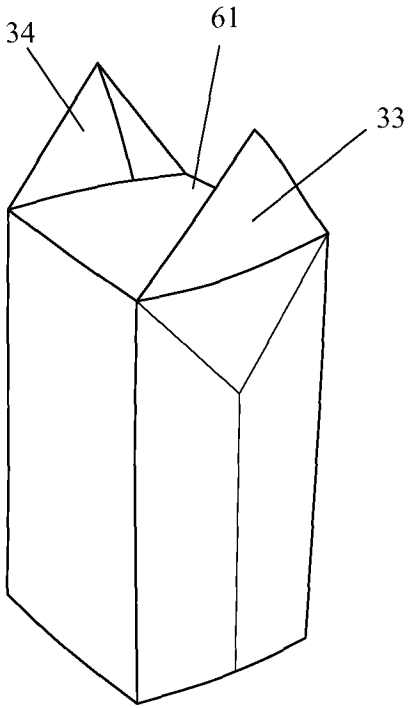
FIG. 6 is a perspective view of the container with the first reinforcing sheet attached to the bottom of the container.
Figure 9:
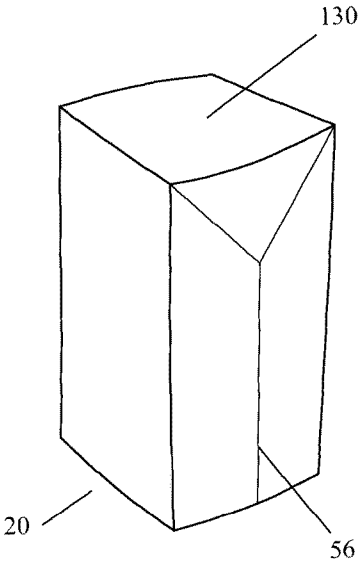
FIG. 9 is a perspective view of the container with second reinforcing sheet attached to the bottom of the container.

Once the first base sides 31 & 32 are folded down to create the first flat bottom 71 as shown in FIG. 4, the first reinforcing sheet 61 is added, as shown in FIG. 5. The first reinforcing sheet 61 has dimensions slightly less than those of the length and width of the finished base 130 of the container 100. The first reinforcing sheet 61 is coated on the bottom side with adhesive and then placed on top of the first flat bottom 71 as shown in FIG. 6.

Figure 8:
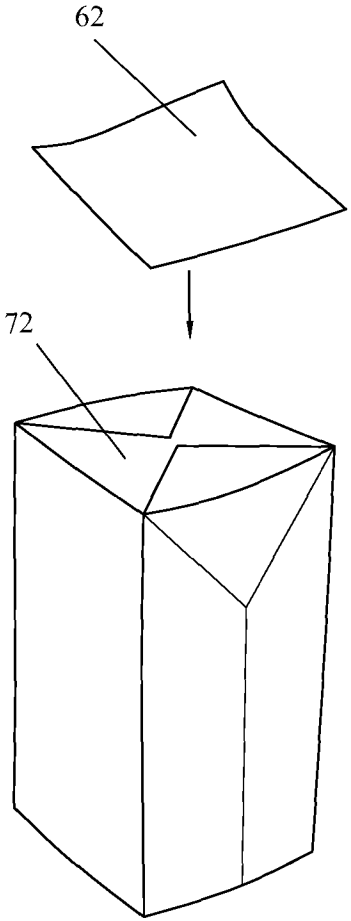
FIG. 8 is a perspective view of the container with the second reinforcing sheet in place to be attached to the bottom of the container.
Figure 7:
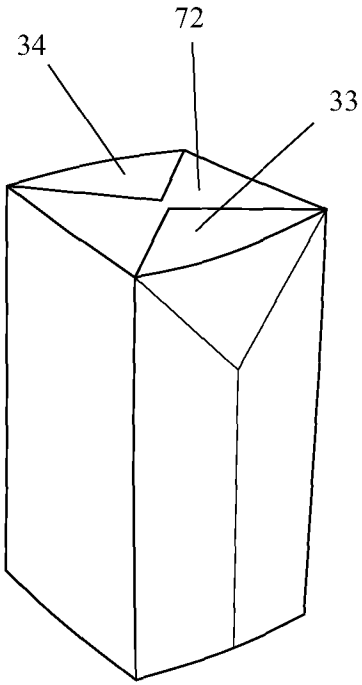
FIG. 7 is a perspective view of the container with the flaps folded onto the bottom.

The next step is to apply adhesive to the upper exposed surface of the first reinforcing sheet 61. Then the opposite base flaps 33 & 34 are folded downward and flattened against the adhesive coated surface of the paper sheet to form the second flat bottom 72, as shown in FIG. 7. The flattening down and compression of the base sides 31 & 32, the first reinforcing sheet 61 and the base flaps 33 & 34 form a leak proof seal in the bottom, or base 130, of the container 100. The next step is to add a second reinforcing sheet 62 which forms the end cap of the base 130 of the container 100, as shown in FIG. 8. The second reinforcing sheet 62 has the same dimensions as the length and width of the finished base 130 of the container 100 to completely cover the base 130 of the container 100. The second reinforcing sheet 62 is coated on the bottom side with the adhesive and then placed on top of the second flat bottom 72 as shown in FIG. 8. The adhered second reinforcing sheet 62 is shown in place in FIG. 9, and forms the leak proof base 130 of the container 100.

The next step is to cure the adhesive with heat and pressure applied over a pre-determined time. This is accomplished with a heat press (not shown) that is designed and configured to press against the horizontal surface of the forming stand, thus compressing and heating the base 130. The heat press is a heated metal plate that is lowered onto the second reinforcing sheet 62, and heat and pressure are applied to the top surface of layers of cardboard forming the base 130 of the container 100. The heat is in the range 100° F. to 300° F. with a most preferred range of 200° F. to 250° F. The pressure is in the range 30 psi to 200 psi with a most preferred range of 60 psi to 100 psi. The heat and pressure is applied for between 5 and 60 seconds, with the most preferable time being 30 seconds. The heat and pressure bond the layers of cardboard and paper together to form the leak proof base 130 of the container 100. The adhesive bonds created between the base sides 31 and 32, and the first and second reinforcing sheets 61 & 62 create a seal of sufficient strength to prevent leakage from the hot melt asphalt poured into the container 100.

Figure 10:
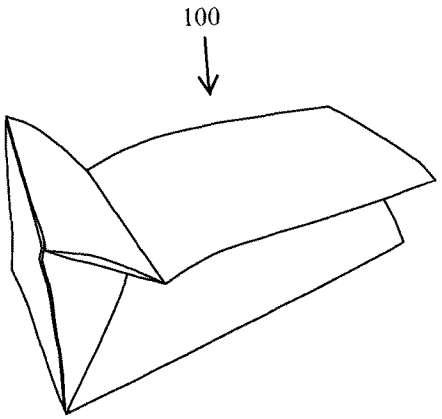
FIG. 10 is a perspective view of the container in the partially folded closed configuration.
Figure 11:
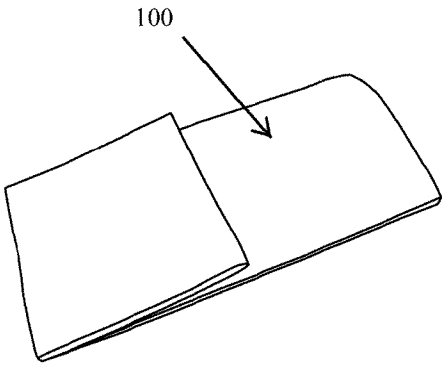
FIG. 11 is a perspective view of the container in the fully folded closed and flat configuration.

After the heat press is removed, the container 100 is removed from the forming stand, and placed with it's open end 20 facing upwards and it's sealed base 130 sitting on a flat surface. The container is then folded flat for shipping. The pre scored collapse folds 56 are pressed in, as shown in FIG. 10 so that the container 100 collapses into a flattened shape as shown in FIG. 11. The flattened container 100 can be is placed in a box or tied in a bundle and palletized ready for shipment.

Figure 12:
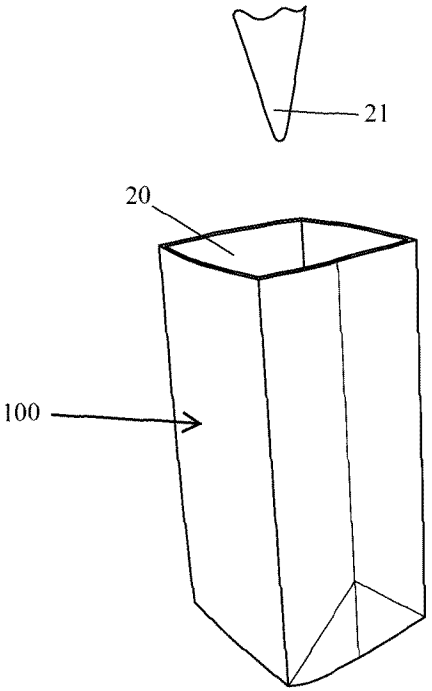
FIG. 12 is a perspective view of the container in the open position with the open end placed to receive the melted asphalt.

When the container 100 reaches the end user asphalt manufacture it can easily be opened by reaching into the top 20 of the container 100 and pressing outward against the collapse folds 56 and unfolding the base 130, not unlike unfolding a paper bag. This is done simply and requires no special equipment. The container 100 that is shipped to the end user is in one piece and ready to be filled. It does not require specialized equipment to form a leak proof container. The container 100 can then be filled with the liquefied asphalt in the conventional manner, as shown in FIG. 12. Typically the asphalt is heated and liquefied and poured into the top 40 of the container 100 through a nozzle 21. The container 100 has sufficient strength to contain the hot liquefied asphalt to allow it to cool, and the base 130 is leak proof to prevent any asphalt from leaking out of the bottom. When the asphalt fills the container 100 the sides of the container bow out under the pressure of the weight of the asphalt to create a substantially cylindrical shape. The adhesives at the edge and the base 130 of the container 100 provide both a leak proof seal, and are sufficiently strong to hold the container 100 together. The full containers 100 are then set to the side and allowed to cool, which allows the asphalt to harden. There is no need for a top for the container because the harden asphalt will not leak out. However, it is possible, and within the conception of the invention, to include a simple cardboard lid to prevent foreign objects from becoming adhered to the solidified but still tacky asphalt. Once the asphalt is cool and hard it can be moved easily in the containers 100. The now cylindrical shape of the container 100 allows for easy staking and moving. The containers 100 will be blocks of hardened asphalt and can be stacked or palletized for shipping. The container 100 forms a protective barrier to prevent the asphalt inside from sticking to other containers 100 or to anything else. The asphalt can then be shipped or transported to the end user. The end user can then easily expose the asphalt by simply tearing away the container 100, and using the asphalt block in the conventional manner. The coating inside the container 100 prevents the container from adhering to the asphalt and allows it to be easily removed without any parts sticking to the asphalt. The end user can the easily dispose of the torn remains of the container 100, and since it is made from paper based cardboard the remains of the container 100 can be recycled or composted. Since the container 100 is made from a single piece of material there is no extraneous material, such as a metal base, that needs to be disposed of.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A method of making a single piece leak proof container for asphalt, comprising the steps of:

providing a heavy duty cardboard;

coating one side of said cardboard with a specialty coating, but leaving an uncoated glue strip, wherein said coated side is the inside surface of the container;

cutting said cardboard into sheets of specified size;

scoring an outside surface of said sheets with embossed fold lines;

folding said sheets in half, applying an adhesive to said uncoated strip and adhering said uncoated strip to a portion of said outside surface of said sheet to create a flat sleeve with the coating on the inside;

opening said flat sleeve to form a rectangular tube by folding along one set of fold lines;

placing said rectangular tube on a form;

folding two bottom sides down onto said form to leave two raised flaps and to create a first flat bottom, wherein said two bottom sides overlap to fully enclose a bottom of said container;

applying an adhesive to the first flat bottom;

attaching a first reinforcing sheet onto said first flat bottom to create a leak proof bottom for the container;

applying an adhesive to said first flat bottom;

folding the two raised flaps down onto said first flat bottom to create a second flat bottom;

providing a second reinforcing sheet;

applying an adhesive to a bottom of said second reinforcing sheet;

attaching said second reinforcing sheet onto said second flat bottom to create a base for the container;

compressing and heating said based against said form to cure said adhesives to create a leak proof base for said container;

removing said container from said form;

folding said container along said fold lines to render said container nearly flat;

stacking said container for shipping and delivering said container to an end use for filling with asphalt;

opening said container such that said container can be filled with hot melt asphalt; and filling said container with a hot melt asphalt.

2. The method of making the one piece leak proof container of claim 1, including the further steps of:

cooling said filled container to allow said asphalt to solidify;

transporting said filled container to a job site;

removing said container from the solidified asphalt; and recycling said container.

3. The method of making the one piece leak proof container of claim 1, wherein said cardboard is made from a multi-ply solid fiberboard having a thickness of between 0.010" and 0.050".

4. The method of making the one piece leak proof container of claim 3, wherein the fiberboard is uncoated 100% virgin kraft fiberboard with a thickness of between 0.013" and 0.035".

5. The method of making the one piece leak proof container of claim 1, wherein the specialty coating is applied at a dry weight of between 1.5 gsm and 3.0 gsm.

6. The method of making the one piece leak proof container of claim 5, wherein the specialty coating is selected from a group consisting of wax, PE polymer, PP polymer, PET polymer, Quillon, Stearic Acid, and Silicone.

7. The method of making the one piece leak proof container of claim 6, wherein the specialty coating is silicone applied at a dry weight of between 1.5 gsm and 3.0 gsm.

8. The method of making the one piece leak proof container of claim 1, wherein the adhesive is selected from a group consisting of water based adhesives, solvent based adhesives, 100% solids liquid adhesives, and hot melt adhesives.

9. The method of making the one piece leak proof container of claim 8, wherein the adhesive is a synthetic emulsion adhesive with a solid content of between 40% and 60%.

10. The method of making the one piece leak proof container of claim 1, wherein the base is compressed with a pressure of between 30 psi and 200 psi.

11. The method of making the one piece leak proof container of claim 10, wherein the base is compressed with a pressure of between 60 psi and 100 psi.

12. The method of making the one piece leak proof container of claim 1, wherein the heat applied to the base is between 100 F and 300 F.

13. The method of making the one piece leak proof container of claim 12, wherein the heat applied to the base is between 200 F and 250 F.

14. The method of making the one piece leak proof container of claim 1, wherein the base is heated and compressed for between 5 seconds and 60 seconds.

15. The method of making the one piece leak proof container of claim 14, wherein the base is heated and compressed for 30 seconds.

16. A method of making a single piece leak proof container for asphalt, comprising the steps of:

providing a heavy duty cardboard, wherein said cardboard is 100% virgin kraft fiberboard with a thickness of between 0.018" and 0.026";

coating one side of said cardboard with a specialty coating, but leaving an uncoated glue strip, wherein said coated side is the inside surface of the container, wherein said coating is silicone applied at a dry weight of between 1.5 gsm and 3.0 gsm;

cutting said cardboard into sheets of specified size;

scoring an outside surface of said sheets with embossed fold lines;

folding said sheets in half, applying an adhesive to said uncoated strip and adhering said uncoated strip to a portion of said outside surface of said sheet to create a flat sleeve with the coating on the inside, wherein the adhesive is a synthetic emulsion adhesive with a solid content of between 40% and 60%;

opening said flat sleeve to form a rectangular tube by folding along one set of fold lines;

placing said rectangular tube on a form;

folding two bottom sides down onto said form to leave two raised flaps and to create a first flat bottom, wherein said two bottom sides overlap to fully enclose a bottom of said container;

applying an adhesive to the first flat bottom;

attaching a first reinforcing sheet onto said first flat bottom to create a leak proof bottom for the container;

applying the adhesive to said first flat bottom;

folding the two raised flaps down onto said first flat bottom to create a second flat bottom;

providing a second reinforcing sheet;

applying the adhesive to a bottom of said second reinforcing sheet;

attaching said second reinforcing sheet onto said second flat bottom to create a base for the container;

compressing and heating said based against said form for 30 seconds to cure said adhesives to create a leak proof base for said container, wherein the base is compressed with a pressure of between 60 psi and 100 psi, and wherein said base is heated to between 200 F and 250 F.;

removing said container from said form;

folding said container along said fold lines to render said container nearly flat;

stacking said container for shipping and delivering said container to an end use for filling with asphalt;

opening said container such that said container can be filled with hot melt asphalt;

filling said container with a hot melt asphalt;

cooling said filled container to allow said asphalt to solidify;

transporting said filled container to a job site;

removing said container from the solidified asphalt; and recycling said container.

* * * * *